US008074511B2

(12) United States Patent
Huiszoon et al.

(10) Patent No.: US 8,074,511 B2
(45) Date of Patent: Dec. 13, 2011

(54) USE OF FLEXIBLE MEMBER FOR BOREHOLE DIAMETER MEASUREMENT

(75) Inventors: Cornelis Huiszoon, Houston, TX (US); Homero C. Castillo, Kingwood, TX (US); Shawn A. Olsen, Spring, TX (US); Roger R. Steinsiek, Houston, TX (US); Gabriel Villasmil, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 1240 days.

(21) Appl. No.: 11/804,909

(22) Filed: May 21, 2007

(65) Prior Publication Data

US 2008/0291048 A1 Nov. 27, 2008

(51) Int. Cl.
*E21B 47/00* (2006.01)

(52) U.S. Cl. ..... 73/152.54; 175/50; 376/25; 702/6

(58) Field of Classification Search ..... 73/152.54; 175/50; 702/6; 367/25
See application file for complete search history.

(56) References Cited

U.S. PATENT DOCUMENTS

| | | | | |
|---|---|---|---|---|
| 6,618,322 | B1 | 9/2003 | Georgi | |
| 6,848,189 | B2 | 2/2005 | Moake et al. | |
| 7,069,775 | B2 | 7/2006 | Fredette et al. | |
| 2006/0064889 | A1 * | 3/2006 | Fredette et al. | 33/544 |
| 2006/0070433 | A1 * | 4/2006 | Fredette et al. | 73/152.18 |

* cited by examiner

*Primary Examiner* — Timothy Edwards, Jr.
(74) *Attorney, Agent, or Firm* — Bracewell & Giuliani, LLP

(57) ABSTRACT

The downhole tool disclosed herein comprises a body, a flexible member attached to the body, and a transducer housed in the body. The flexible member compresses against one side of the wellbore and urges the body against the other side. The transducer emits a signal to the flexible member reflectable from the flexible member back to the transducer. The signal travel time from the transducer to the flexible member and back is analyzed for estimating the distance between the body and the flexible member. The standoff distance can be estimated from the distance between the body and the flexible member. From the standoff distance, the wellbore diameter is estimated. The tool may also obtain wellbore dimensions by obtaining near side wellbore standoff and using a magnetic ruler to determine bowspring flexing. The magnetic ruler results may be used in conjunction with or without the far side standoff data.

32 Claims, 5 Drawing Sheets

USE OF FLEXIBLE MEMBER FOR BOREHOLE DIAMETER MEASUREMENT

BACKGROUND OF THE INVENTION

1. Field of the Invention

The disclosure herein relates generally to the field of obtaining measurements in a subterranean wellbore. More specifically, the present disclosure relates to an apparatus and method for estimating wellbore dimensions.

2. Description of Related Art

An uncased or open hole wellbore diameter can vary along its length. Many devices used for open hole borehole evaluation require accurate knowledge of the wellbore diameter. Additionally, borehole dimension variations can adversely affect data gathering by these devices unless the variations are detected and taken into account during the investigation process. Some currently known open hole interrogation tools capable of evaluating wellbore diameters employ pivoting mechanical arms that extend from the tool up against the wellbore wall. Measuring the arm extension and its pivot angle can be used to determine wellbore diameter.

Other tools include acoustic transmitters that emit an acoustic signal from the tool against the wellbore wall. The signal travels from the transmitter through the wellbore fluid and back to the tool. The signal is received and its travel time to and from the wellbore wall is measured. The tool standoff (distance between the tool housing and wellbore wall) may be calculated based on the measured travel time. The wellbore diameter can then be determined from measured standoff distances and the tool diameter. The amplitude of the reflected acoustic signal will depend on the acoustic impedance contrast between the wellbore fluid and the rock surrounding the borehole, as well as the surface (or geometrical) properties of the borehole wall. Moreover, the acoustic signal may be attenuated by the fluid in the borehole. If the acoustic impedance contrast is small, the reflected signal will be small and may be hard to detect.

BRIEF SUMMARY OF THE INVENTION

Disclosed herein is a downhole tool comprising, a body, a flexible member coupled to the body, one or more signal sources, and one or more signal receivers, wherein a signal source is focused to emit a signal to be reflected from the flexible member surface and a signal receiver is focused to receive the reflected signal.

Another embodiment disclosed herein is a wellbore standoff measurement device comprising, a body, a flexible member coupled to the body, a signal source configured to generate a signal reflectable from the borehole wall, a signal receiver configured to receive a signal reflected from the borehole wall, a slideable connector disposed on one or both ends of the flexible member, and one or more sensors in communication with the slideable connector(s).

Also included herein is a downhole tool comprising, a body, a transducer having an acoustic path, a flexible member coupled to the body disposed in the acoustic path, and a calibration target disposed in the transducer's acoustic path, wherein the target comprises a reflectable surface.

A method of estimating a borehole dimension is disclosed herein, the method comprising, disposing a tool within a wellbore, wherein the tool comprises a transducer, a body, and a flexible member, generating a signal with the transducer, reflecting the signal from the flexible member surface thereby creating a reflected signal, receiving the reflected signal; and estimating the wellbore diameter based on the received reflected signal.

A method of estimating a borehole dimension is disclosed herein, the method comprising, disposing a tool within a wellbore, wherein the tool comprises a transducer, a body, and a flexible member with a slideable connector in communication with a sensor, generating a signal with the transducer, reflecting the signal from the borehole wall, receiving the reflected signal; and estimating the wellbore diameter based on the received reflected signal and the position measurement obtained with the slideable connector.

DETAILED DESCRIPTION OF THE INVENTION

The device and method disclosed herein is useful for estimating wellbore dimensions, such as its diameter. In one embodiment, the device comprises a body disposable in the wellbore having a flexible member coupled to the body, wherein the flexible member has a generally elongated form. The member is attachable to the body at its ends and flexes outward away from the body in its mid-section. A side view of the flexible member coupled to the body resembles a half ellipse. The device width (i.e. the distance from the member apex to the body near side) should exceed the wellbore diameter. Thus when disposed in a wellbore the flexible member apex is compressed against one side of the wellbore which pushes the device body toward the other side of the wellbore. In situations when the flexible member apex contacts one wellbore side and the body near side contacts the opposing wellbore side, the distance from the flexible member apex to the body near side equals the wellbore diameter. This distance equals the sum of the body diameter and the distance from the flexible member apex to the body far side.

Unlike the distance from the flexible member apex to the device body far side, the device body diameter will be substantially unchanged when disposed in the wellbore. Thus the wellbore diameter can be estimated by first estimating the distance from the body far side to the flexible member apex (tool standoff distance at far side). One manner of estimating the apex to body far side distance involves measuring the sound travel time from the body far side to the flexible member apex. The measurement can track a direct path from the far side to apex, or a reflected path from the body far side to the flexible member and back to the body far side. In situations where the body near side does not contact the formation, another transducer may be employed for determining the distance between the body near side and other wellbore side.

Figure 1:
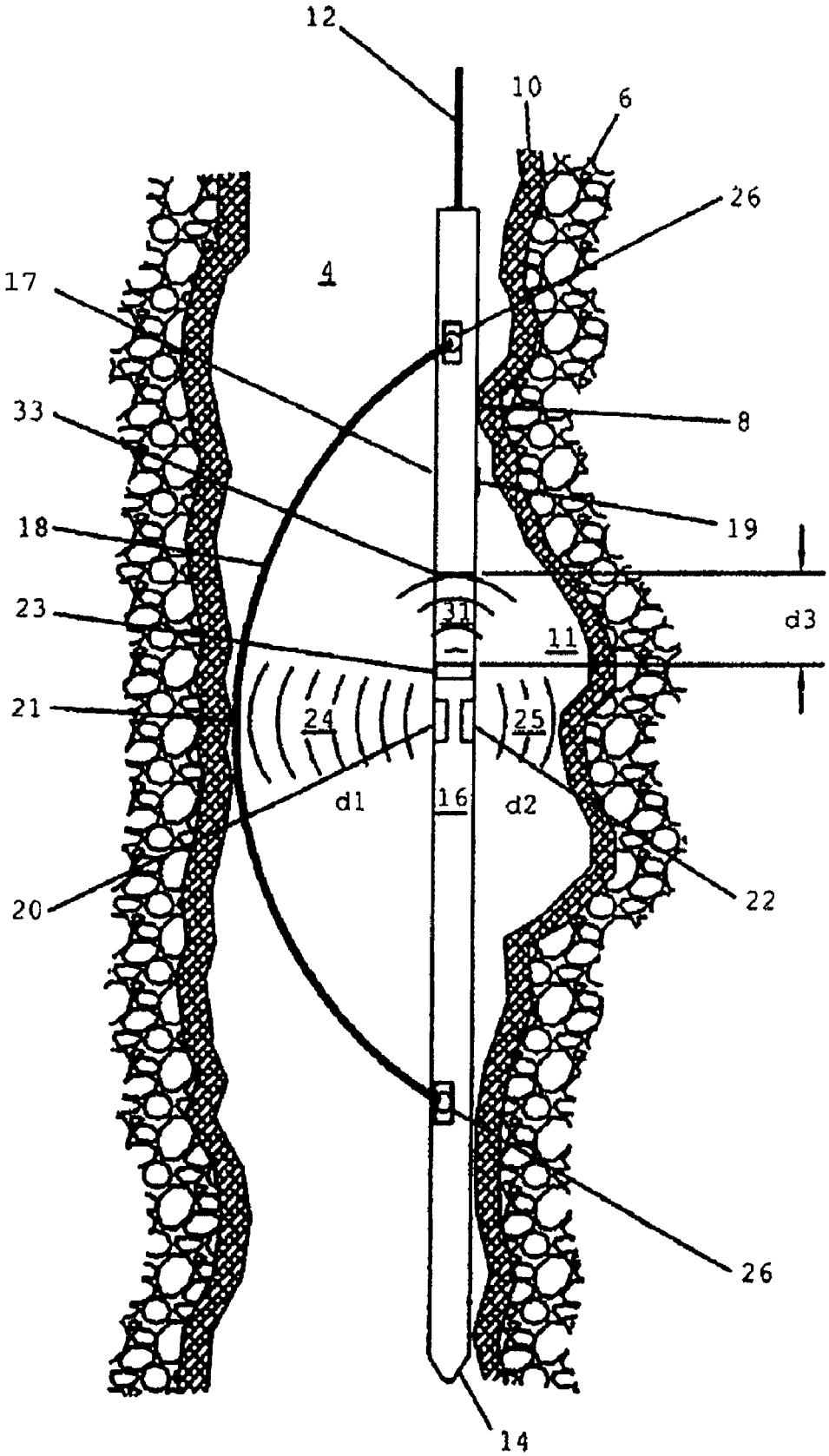
FIG. 1. is a partial cut away side view of an embodiment of a downhole tool disposed in a wellbore.

With reference now to FIG. 1, one embodiment of a downhole tool 14 is shown in side view disposed within a wellbore 4. In the embodiment shown, the wellbore 4 extends through a formation 6 wherein the wellbore wall 8 is lined with mudcake 10. The downhole tool 14 comprises a body 16 with a flexible member 18 coupled to the body outer surface. The downhole tool 14 is shown suspended within the wellbore 4 by wireline 12, but other suspension means can be used as well, such as tubing, coiled tubing, slickline, and drill pipe. The downhole tool 14 may be used alone, or in combination with other subterranean devices.

The flexible member 18 of FIG. 1, also referred to herein as a bow spring, is an elongate member securable to the body 16 on its ends by connectors 26. The flexible member 18 should be sufficiently pliable so it can bend when disposed in the wellbore 4, but yet have ample Young's modulus to urge the body near side 19 against the wellbore wall 8 when compressed. As shown, the flexible member 18 has a semi-elliptical shape wherein its apex 21 is the region of the member 18 farthest away from the body far side 17. The apex 21 and its surrounding region is in contact with the wellbore wall 8 substantially opposite of where the body near side 19 contacts and/or is proximate to the wellbore wall 8. The flexible member 18 connectors 26 are shown substantially aligned with the wellbore axis, however the connectors 26 can be positioned in other angular arrangements on the tool body 16, such as on a line oblique to the tool axis. Typically the flexible member 18 cross-section will have a width that exceeds its thickness, however the member 18 is not limited to this rectangular shape but can have multiple configurations. Configurations exist where its width and thickness are substantially the same, moreover these dimensions may vary along its length. Optionally it may have a cylindrical cross section. The member 18 may be solid or comprise a hollow core.

Transducers (20, 22) are shown included with the downhole tool 14. In the embodiment of FIG. 1, one transducer 20 is disposed on the far side 17 and the other transducer 22 is disposed on the near side 19. However other variations may be employed, such as both transducers (20, 22) at a single location on the tool 14, one or more within the body 16, or at the same side of the tool but different heights on the tool. Optional embodiments may include a single transducer or more than two transducers. In FIG. 1, the transducer 20 on the body far side 17 emits a signal 24, thus being a signal source. As shown the signal 24 is an acoustic (compressional) wave. The transducer may comprise a piezoelectric device, an electro-magnetic acoustic transmitter as well as a wedge transducer. The flexible member 18 of this embodiment should be comprised of a material having reflective qualities for reflecting a signal from the transducer 20. Examples of such materials include metals such as carbon steel, stainless steel, copper, brass, nickel, combinations thereof and objects coated with these materials. The signal created by the transducer 22 is directed at the wellbore wall oppositely disposed from the apex 21.

One mode of operation of the embodiment of FIG. 1 comprises generating a signal by transducer 20 and transducer 22 while the tool 14 is disposed in the wellbore 4. The signal 24 created by the transducer 20 is directed at the flexible member 18 inner surface (the surface facing the body far side 17) so that the signal reflects from the flexible member itself, i.e. not from something affixed to the flexible member 18 or some other object. After reflecting from the flexible member 18, the signal travels back to the tool where it is received and recorded. The transducer 22 also generates a signal 25 that travels through the wellbore fluid. Except signal 25 is aimed at the wall 8 closest the transducer 22. The resulting signal reflecting from the wall 8 closest the transducer 22 may be received and recorded by the transducer 22. It may be necessary to recess the transducer 22 in order that a minimum distance is maintained between the transducer 22 and the borehole wall. Recording their respective reflective signals can be done by the transducers (20, 22), optionally receivers dedicated for receiving reflected signals may be used.

When traveling between the tool body 16 and the flexible member 18, the signal will likely propagate through wellbore fluid. Knowing the fluid sound speed and measuring the time travel through the fluid, the distance traveled by the signals through the fluid can be determined. The fluid sound speed may be measured downhole by reflecting an acoustic signal that travels in the downhole fluid off a target at a fixed and known distance from a transducer. In the embodiment of FIG. 1, a transducer 23 sends an acoustic signal across a cavity 31 that is open to the wellbore fluid and receives the reflected signal from the opposing wall 33 of the cavity 31. The fluid sound speed is computed as $v=2*d_3/T_3$ where $T_3$ is the time measured for the signal to travel from the transducer 23 across the cavity 31 and back. A controller (not shown) may be included with or otherwise in communication with one or both transducer(s) for measuring the signal (24, 25) time travel through the fluid. For example, if the signal travel time ($T_1$) is measured from the body far side 17 to the flexible member apex 21 and back, that distance ($d_1$) can be estimated by the following relationship: $d_1=v*T_1/2$; where v is the wellbore fluid sound speed. The distance ($d_2$) between the transducer 22 and the borehole wall 8 can be estimated by $d_2=v*T_2/2$, where $T_2$ is the time measured for signal 25 to travel from the transducer 22 to the borehole wall 8 and back. Adding the thickness of the flexible member 18 and width of the tool body 16 to the values of $d_1$ and $d_2$ provides an estimate of the wellbore diameter $D_1$. An advantage of using the flexible member 18 itself to provide a reflective surface is the reduction of components as well as enhanced robustness. One of the advantages of using the near side transducer 22 is its ability to detect a recess 11 in the wellbore wall 8 instead of assuming the wall 8 has a continuous surface.

The controller may be a processor included with the tool 14 or may be at surface. Optionally the controller may comprise an information handling system (IHS). An IHS may be employed for controlling the generation of the signal herein described as well as receiving the controlling the subsequent recording of the signal(s). Moreover, the IHS may also be used to store recorded data as well as processing the data into a readable format. The IHS may be disposed at the surface, in the wellbore, or partially above and below the surface. The IHS may include a processor, memory accessible by the processor, nonvolatile storage area accessible by the processor, and logics for performing each of the steps above described.

Figure 2:
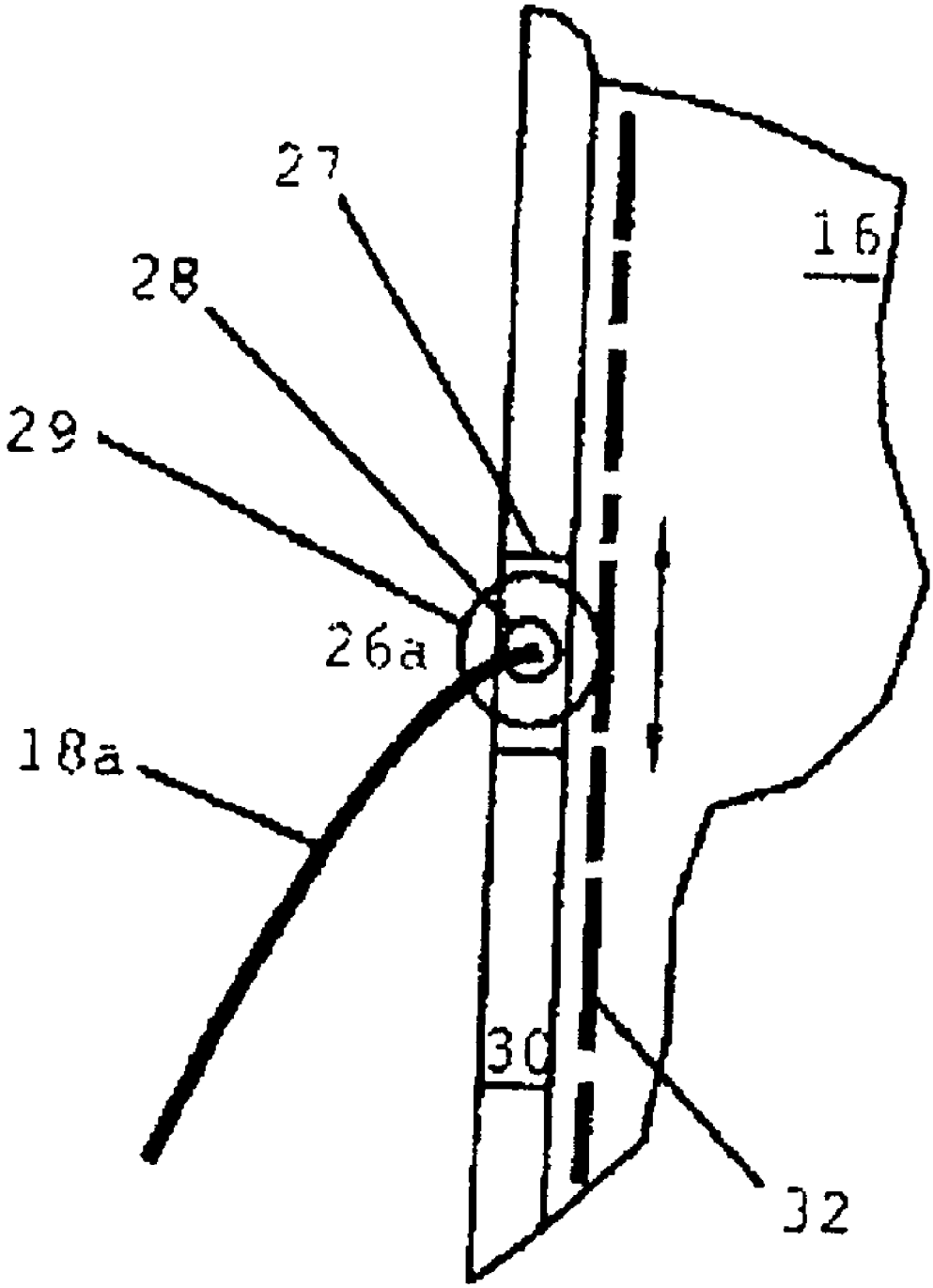
FIG. 2 is a side view of a flexible member connector.

FIG. 2 is a side view illustrating an embodiment of a connector **26*a* for an end of the flexible member 18*a*. The connector 26*a* may be integrally formed within the tool body 16 or affixed to its outer surface. In this embodiment a pin 28 couples with a terminal end of the flexible member 18*a*. The pin axis is substantially perpendicular to the member length. The coupling may securedly affix the pin 28 and member 18*a*; optionally the pin 28 may rotate on its axis with respect to the member 18*a***.

In the embodiment of FIG. 2, the pin 28 resides in a channel 30 that allows for lateral pin movement generally parallel to the axis of the tool 14. Included with the pin 28 is a magnetic source 29 that selectively creates a magnetic field in its surrounding region. The magnetic source 29 may comprise a permanent magnet or an electromagnet. The channel 30 provides an enclosure for the pin 28 and is secured to the connector base 27. Sensors 32 are shown disposed within the connector base 27. The sensors 32 are responsive to the magnetic field created by the magnetic source 29. This embodiment of the connector **26*a*** may be referred to as a "magnetic ruler."

As noted above, when the flexible member apex 21 is fully outwardly extended, the distance between the apex 21 and the body near side 19 will likely exceed the wellbore diameter, thus when disposed within the wellbore 4 the flexible member 18 will flex inward towards the tool body 16. With regard to the connector 26*a* of FIG. 2, when the member 18 flexes inward it has sufficient resiliency to push the pin 28 along the channel 30 away from the apex 21. The pin 28 movement and location, along with its associated magnetic source 29 is detectable by the sensors 32. In one embodiment the sensors 32 comprise Hall effect sensors that generate a voltage whose magnitude correlates to the strength of the magnetic field produced by the source 29 (and thus its proximity). As such, the location of the pin 28 (and thus the flexible member end) is determinable by monitoring sensor 32 voltage output. Through tool calibration, the amount of flexible member 18 inward flexing (due to being inserted in the borehole) can be correlated to the pin 28 position. As discussed above, the wellbore diameter can be derived based on the amount of inward flexing by the member apex 21. It is well within the capabilities of those skilled in the art to calibrate the tool for estimating the flexible member 18 inward flexing based on pin 28 position (thereby establishing an estimate of borehole dimension). Therefore tracking pin 28 movement by the sensors 32 provides a manner of estimating wellbore diameter. The disclosure herein is not limited to the embodiment of FIG. 2, but can include devices having any number of sensors, including a single sensor. Moreover, either end of the flexible member 18 can be attached with the connector 26*a* (upper or lower), or the connector 26*a* may be used to couple both ends of the member 18 to the body 19.

In one embodiment of use, the signal features of FIG. 1 can be combined with the "sensor" attachment of FIG. 2 to estimate the standoff distance. Advantages of such a combination provide a redundant manner of determining this distance. Moreover, in some instances, signal accuracy may become diminished with increased stand off distance due to attenuation of the acoustic signal. On the other hand, the sensor 32 embodiment is accurate over all expected standoff distances. Accordingly the combination of a method and device comprising using recorded signals along with a method and device utilizing a movement sensor provides accurate wellbore diameter measurements for a wide range of standoff values. Thus a wellbore dimension (diameter) may be estimated using data signals recorded from the flexible member (far side measurement), near side measurement, and from the magnetic ruler.

In one embodiment, the standoff distance measurement at the near side of the tool obtained with transducer 22 of FIG. 1 is combined with the standoff distance measurement at the far side of the tool obtained with the sensor attachment of FIG. 2 to provide an accurate borehole diameter measurement. Optionally, borehole dimensions may be derived by a combination of a near side measurement (such as by the acoustic transducers above described) and pin movement measurement by a sensor (magnetic ruler). In instances where the recess 11 dimensions are ignored, the wellbore diameter can be estimated by analyzing signals reflecting from the bowspring alone and without other recorded data. In yet another embodiment, a borehole diameter may be obtained simply from analyzing data from the magnetic ruler.

Figure 3:
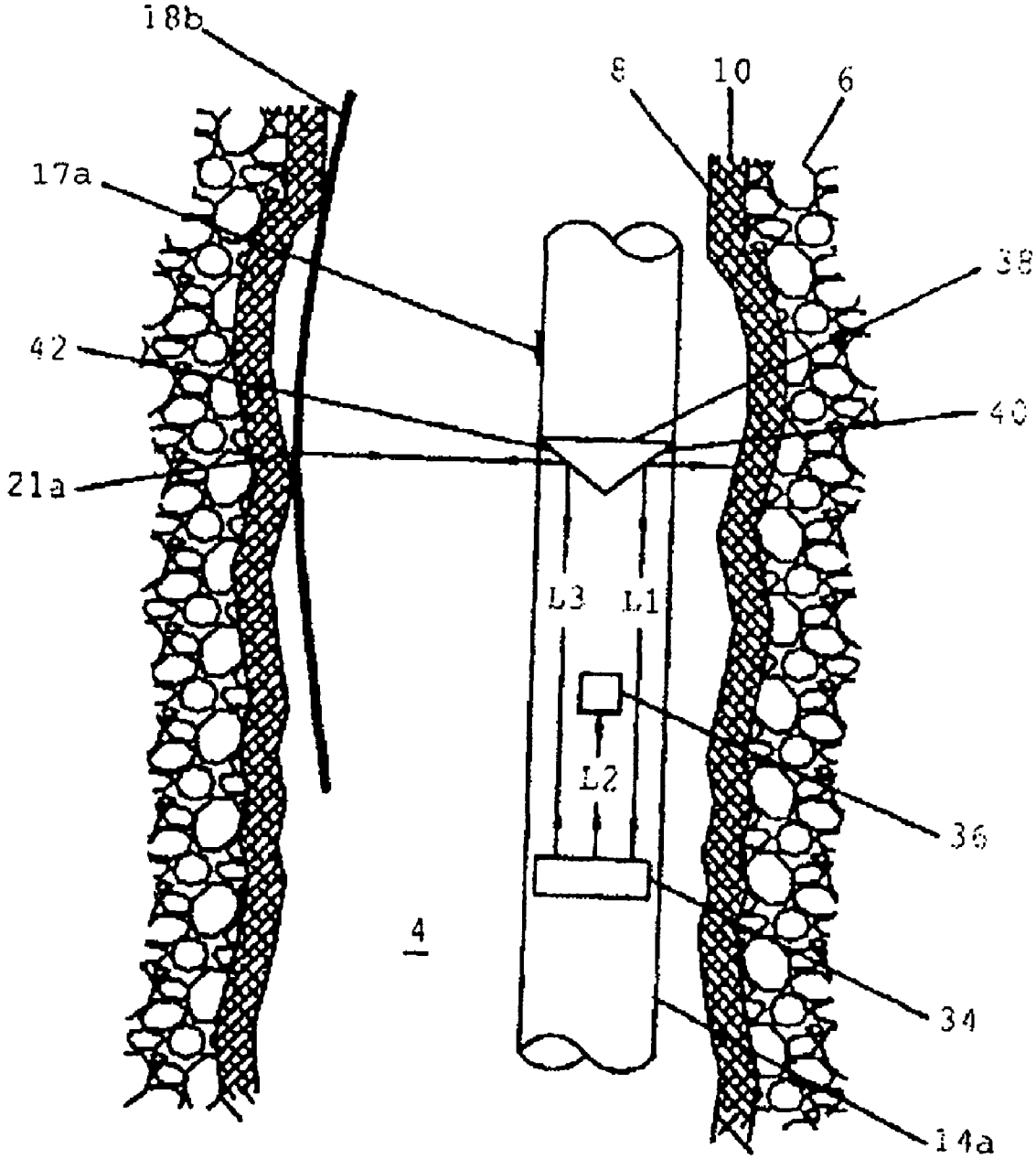
FIG. 3 is a partial cut-away side view of an embodiment of a downhole tool with a transducer and flexible member.

Wellbore fluid sound speed can be determined by transmitting a signal across a known distance through wellbore fluid, then measuring the signal propagation time across that distance. A dedicated calibration transducer can be used to transmit and receive the signal as shown in the embodiment of FIG. 1. FIG. 3 provides an optional embodiment wherein fluid sound speed calibration and wellbore standoff may be estimated using the same transducer. In the embodiment of FIG. 3 a transducer 34 is shown disposed within a downhole tool 14*a*. A target 36 and reflector 38 are also included with the tool 14*a* where wellbore fluid fills the space between the transducer 34, the target 36, and the reflector 38. The transducer 34 operates as a signal source for transmitting a propagating signal through the wellbore fluid surrounding the tool 14*a*. Both the target 36 and the reflector 38 are disposed in the transducers signal path.

The lines (L1, L2, and L3) of FIG. 3 illustrate potential signal travel paths. L2 illustrates a signal emanating from the transducer 34, reflecting from the target 36, and the reflected signal returning to the transducer 34. As discussed above, wellbore fluid sound speed can be derived based on the signal travel time from the transducer 34 to the target 36 and back. The reflector 38 of FIG. 3 has oblique surfaces 40 and 42 such that a signal directed from the transducer 34 does not reflect directly back to the transducer 34, but instead is diverted laterally away from the reflector 38. One surface 42 is configured to divert the acoustic signal to the apex region 21*a* of the flexible member 18*b*. As shown the apex 21*a* is urged against the wellbore wall 8. Since the signal is directed substantially perpendicular to the apex 21*a*, its reflection from the flexible member 18 returns to the reflector oblique surface 42. After reaching the reflector oblique surface 42, the reflected signal is directed to the transducer 34 due to the surface 42 angle. In this embodiment, the respective distances between the oblique surface 42 and transducer 34 and tool far side 17a are measureable. Thus the standoff distance between the far side 17*a* and the apex 21*a* is easily determinable from the measured signal time travel and wellbore fluid sound speed. By similarly measuring distance L1, the standoff distance on the near side of the tool is determined. The borehole diameter is computed as the sum of the standoff distances on the near and far side, the tool diameter and the thickness of the flexible member. Even if the tool is not fully eccentered by the flexible member, the borehole diameter will be accurately measured. Moreover, the distance measurement derived from L1 will provide an indication of borehole rugosity. It is assumed that distance L1 is less than distance L3 during normal operation of the tool.

Figure 4:
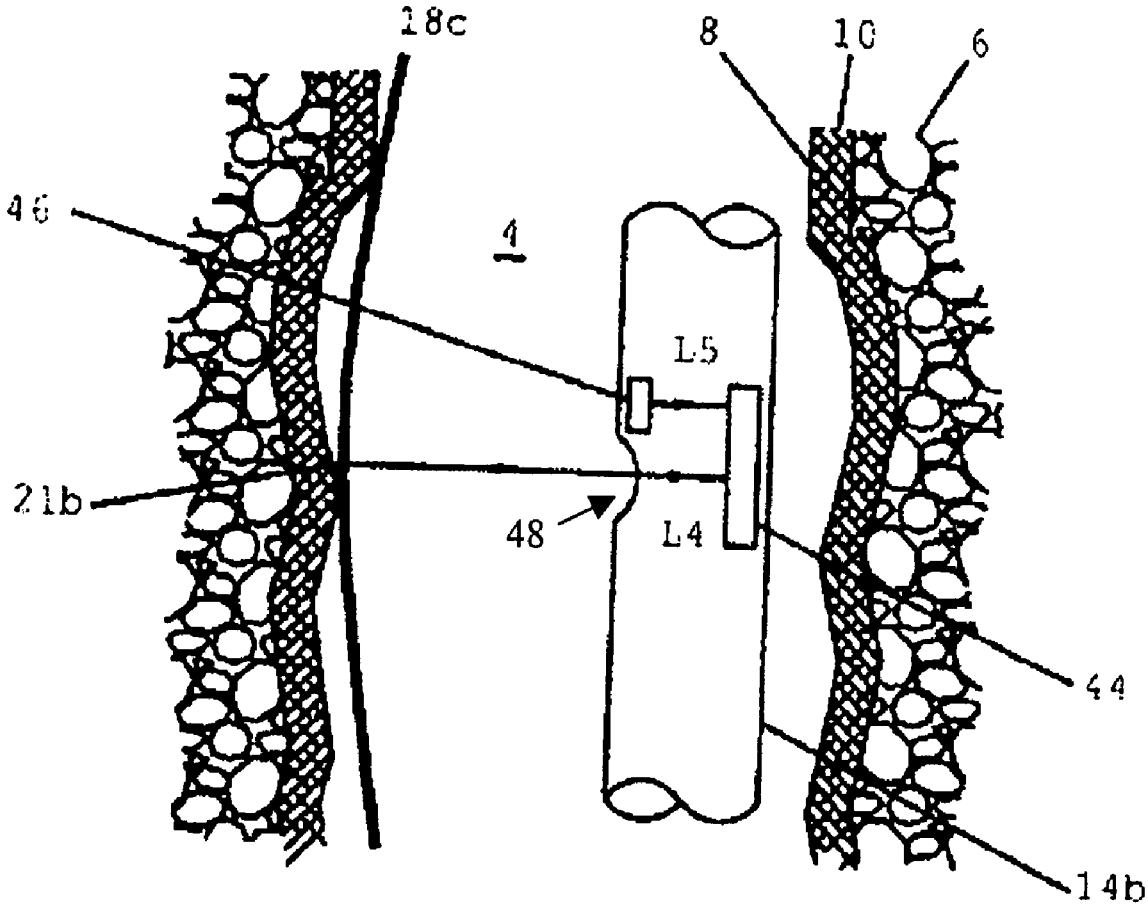
FIG. 4 is a partial cut-away side view of another embodiment of a downhole tool with a transducer and flexible member.

FIG. 4 provides another embodiment of a wellbore tool using a single transducer for both determining wellbore fluid sound speed and for estimating the standoff distance. In this embodiment a transducer 44 is positioned substantially perpendicular to the axis of the tool 14*b*. The transducer 44 is also positioned to emit a signal aimed towards the corresponding flexible member apex 21*b*. A target 46 is disposed in the signal path. As with the target 36 of FIG. 3, the target 46 is useful for determining wellbore fluid sound speed—measuring the time travel of L5 may be used for the sound speed determination. An opening 48 is provided in the wall of the tool body 16*a* to allow signal travel (represented by L4) from the transducer 44, to the flexible member 18*c* and back. The transducer 44 is oriented such that the signal contacts the flexible member 18*c* at roughly its apex 21*b*.

It should be pointed out that each of the transducers above described can operate solely as a signal source or as a single receiver. The embodiments discussed having a single transducer could substitute a signal source and signal receiver for the single transducer. Additionally, the signals may comprise any type of acoustic signal discussed above, as well as other signals including optical signals.

It should also be pointed out that the signal reflecting from the inner surface of the flexible member is not limited to contacting the flexible member at its apex, but can be aimed at any known location along the length of the member. The standoff distance can be extrapolated by knowing the distance from the transducer to the location on the member intersected by the signal.

Figure 5:
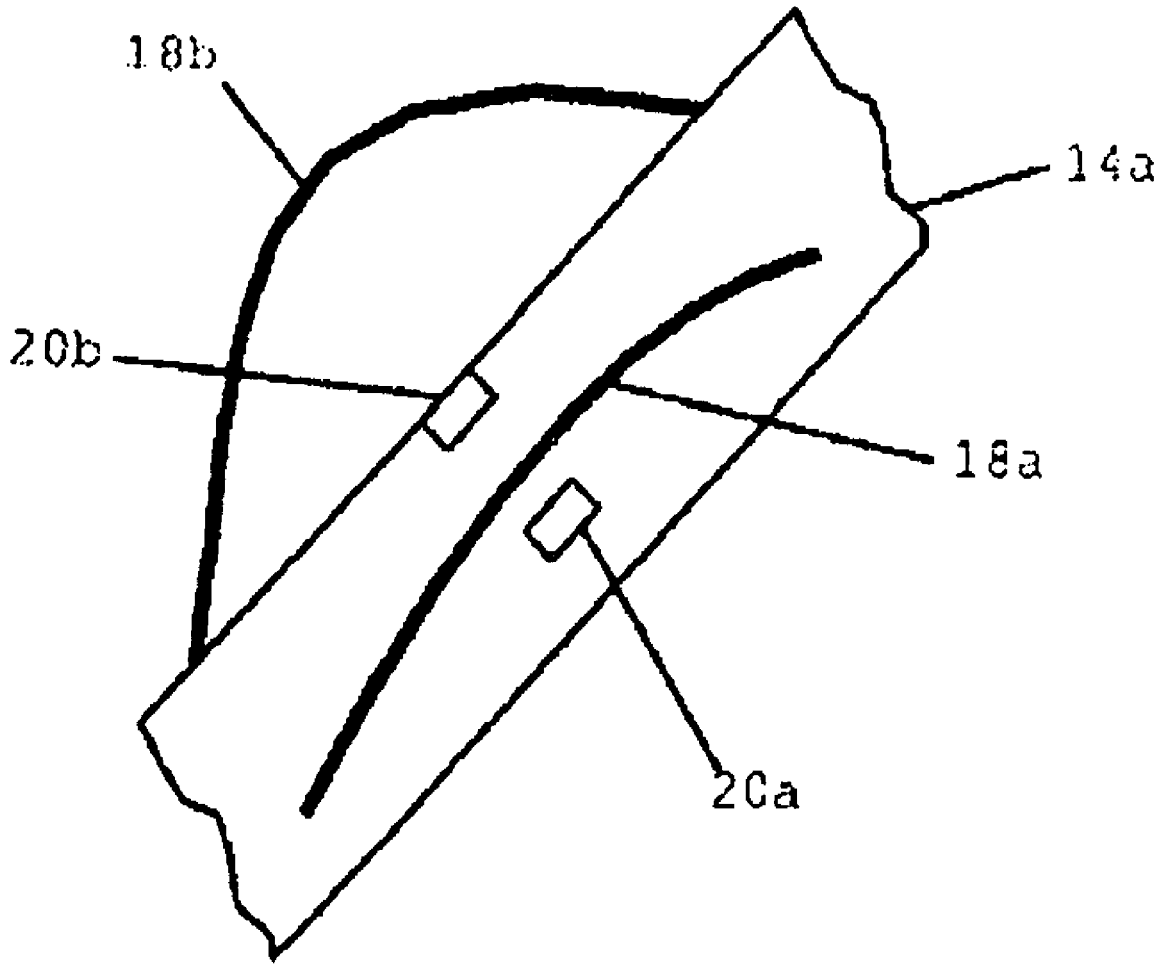
FIG. 5 is an embodiment of a downhole tool having multiple flexible members.

An optional downhole tool 14*a*, as shown in FIG. 5, may comprise multiple bowsprings (18*a* and 18*b*). These flexible members should be at substantially the same axial location on the tool body but disposed apart at some angle. The angle can range from about 45° to about 180° and angles between, other specific angles considered include 90°, 100°, 120° and 145°. Embodiments of the device disclosed herein include more than two flexible members as well.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, control of the embodiments herein described may be performed by an information handling system, either disposed with the tool or at surface. These and other similar modifications will readily suggest themselves to those skilled in the art, and are intended to be encompassed within the spirit of the present invention disclosed herein and the scope of the appended claims.

What is claimed is:

1. A downhole tool comprising:

a body;

a flexible member coupled to the body having a surface spaced away from and facing the body, so that when the downhole tool is disposed in a wellbore, the flexible member contacts a far side of the wellbore and a side of the body distal from surface contacts a near side of the wellbore;

a far side signal source directed at the surface;

a far side signal receiver disposed to receive a signal emitted from the far side signal source and reflected from the surface;

a near side signal source directed away from the surface;

a near side signal receiver disposed to receive a signal emitted from the near side signal source and reflected from the near side of the wellbore.

2. The downhole tool of claim 1, wherein the far side signal source and far side signal receiver are within a single transducer and wherein the near side signal source and near side signal receiver are within a single transducer.

3. The downhole tool of claim 1, wherein the far side signal source and the near side signal source are selected from the group consisting of a piezoelectric device, an electro-magnetic acoustic transducer, and a flexural resonator.

4. The downhole tool of claim 1, wherein the signal from the far side signal source comprises an acoustic wave and the signal from the near side signal source comprises an acoustic wave.

5. The downhole tool of claim 1, wherein the far side signal source and far side signal receiver are disposed at different locations.

6. The downhole tool of claim 1, wherein the far side signal source and far side signal receiver are disposed at substantially the same location.

7. The downhole tool of claim 1, wherein the signal emitted by the far side signal source is used to estimate a wellbore dimension.

8. The downhole tool of claim 1, wherein the signal emitted by the near side signal source is used to identify a recess in the near side of the wellbore.

9. The downhole tool of claim 1, further comprising another flexible member coupled to the body.

10. A wellbore measurement device comprising:

a body;

an elongate flexible member having opposing ends coupled to the body;

a channel provided on the body;

a sideable connector comprising a pin mounted on an end of the flexible member and slidable within the channel; and a sensor in communication with the slideable connector, so that the wellbore measurement device is disposed in a wellbore, the slideable connector axially moves within the channel in response to contact between a mid-point of the flexable member and a wall of the wellbore and the location of the sideable connector in the channel reflects a diameter of the wellbore and is sensed by the sensor.

11. The wellbore measurement device of claim 10, further comprising a magnetic field source in the slideable connector and wherein the sensor is responsive to a magnetic field.

12. The wellbore measurement device of claim 10, wherein the sensor comprises a Hall effect sensor.

13. The wellbore measurement device of claim 10 further comprising a permanent magnet disposed within said slideable connector.

14. The wellbore measurement device of claim 10, further comprising a second slideable connector on an end of the flexible member.

15. The wellbore measurement device of claim 10, further comprising a signal source configured to generate a signal reflectable from the flexable member and a signal receiver configured to receive a signal reflected from the flexable member.

16. The wellbore measurement device of claim 10, further comprising a processor configured to determine wellbore dimensions based on the location of the slidable connector in the channel sensed by the sensor.

17. The downhole tool of claim 10 further comprising an acoustic near side standoff measurement transducer.

18. A downhole tool comprising:

a body;

a transducer having an acoustic path;

a flexible member coupled to the body and disposed in the acoustic path; and a calibration target disposed in the transducer's acoustic path, wherein the target comprises a reflectable surface, wherein the transducer is configured to produce a signal along the acoustic path to produce a reflected signal from the flexable member surface and a reflected signal from the target.

19. The downhole tool of claim 18, wherein the space between the transducer and the calibration target is configured to receive wellbore fluid.

20. The downhole tool of claim 18 wherein the calibration target's reflectable surface is substantially perpendicular to the acoustic path.

21. The downhole tool of claim 18 wherein the calibration target's reflectable surface is substantially oblique to the acoustic path.

22. The downhole tool of claim 18 wherein the calibration target comprises a second reflectable surface.

23. The downhole tool of claim 18, wherein the flexible member is configured to deform in response to wellbore diameter.

24. The downhole tool of claim 18 further comprising a processor configured to estimate the wellbore diameter based on signals reflected from the flexible member surface and from the target.

25. The downhole tool of claim 18 further comprising a receiver configured to receive signals reflected from the flexible member surface and from the target.

26. The downhole tool of claim 25, wherein the receiver is combined with the transducer.

27. A method of estimating a borehole dimension comprising:

providing a body disposable in a wellbore, a flexable member coulpled to the body having a surface spaced away from and facing the body, a far side signal source directed at the surface, a far side signal receiver disposed to receive a signal emitted from the far side signal source and reflected from the surface, a near side signal source directed away from the surface, and a near side signal receiver;

disposing the body in the wellbore so that a side of the flexible member opposite the surface contacts a wall of the wellbore and urges a distal side of the body against an opposite wall of the wellbore;

creating a far side reflected signal by emitting a signal from the far side signal source that reflects from the surface;

receiving the far side reflected signal;

creating a near side reflected signal by emitting a signal from the near signal source that reflects from the opposing wall of the wellbore;

receiving the near side reflected signal; and estimating a diameter of the wellbore based on a time duration defined by when the signal was emitted from the far side signal source and when the far side reflected signal was received and a time duration defined by when the signal was emitted from the near side signal source and when the near side reflected signal was received.

28. The method of claim 27 wherein the step of estimating wellbore diameter further comprises monitoring movement of a terminal end of the flexible member.

29. The method of claim 27, further comprising identifying a recess in the wellbore wall by analyzing the near side reflected signal.

30. The method of claim 27 further comprising measuring the flexible member deformation in the wellbore using a magnetic ruler, and estimating a borehole dimension including the measured deformation.

31. The method of claim 27 wherein the tool further comprises a calibration target disposed in the path between the transducer and the flexible member.

32. The method of claim 31 further comprising receiving a reflected signal from the calibration target and estimating wellbore fluid sound speed based on the received reflected signal.

* * * * *